US010074949B1

(12) United States Patent
Chang et al.

(10) Patent No.: US 10,074,949 B1
(45) **Date of Patent: *Sep. 11, 2018**

(54) ELECTRONIC DEVICE AND A METHOD FOR DETECTING THE CONNECTING DIRECTION OF TWO ELECTRONIC COMPONENTS

(71) Applicant: GETAC TECHNOLOGY CORPORATION, Hsinchu County (TW)

(72) Inventors: Chin-Jung Chang, Taipei (TW); Chui-Shien Li, Taipei (TW); Yao-Wei Yang, Taipei (TW)

(73) Assignee: GETAC TECHNOLOGY CORPORATION, Hsinchu County (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/848,665

(22) Filed: Dec. 20, 2017

Related U.S. Application Data

(63) Continuation of application No. 15/456,412, filed on Mar. 10, 2017, now Pat. No. 9,899,783.

(51) Int. Cl.
*H01R 29/00* (2006.01)
*H01R 13/703* (2006.01)

(52) U.S. Cl.
CPC ..... *H01R 29/00* (2013.01); *H01R 13/7039* (2013.01)

(58) Field of Classification Search
CPC ..... H01R 13/6205; H01R 13/6683; H01R 13/641; H01R 2107/00; H01R 13/64; H01R 24/60; H01R 24/58; H01R 13/24; H01R 13/642; H01R 13/665; H01R 13/6691; H01R 2201/06; H01R 24/62; H01R 29/00
See application file for complete search history.

(56) References Cited

U.S. PATENT DOCUMENTS 7,035,115 B2 * 4/2006 Walesa ..... H01R 25/164 307/147
7,859,219 B2 * 12/2010 Harris ..... B60L 11/1818 320/104
9,899,783 B1 * 2/2018 Chang ..... H01R 29/00
2005/0083067 A1 * 4/2005 Kirbas ..... G01R 31/023 324/539

(Continued)

*Primary Examiner* — Truc Nguyen

(57) ABSTRACT

An electronic device includes a first electronic component and a second electronic component. The first electronic component includes a control unit and a first connector. A first pin group of the first connector includes an even number of first detect pins. The second electronic component includes a second connector that matches with the first connector. A second pin group of the second connector includes an even number of second detect pins. When the first connector is electrically connected to the second connector, each of the first detect pins is electrically connected to each of the second detect pins to form a conductive path. All of the first detection pins and the second detection pins connected with one another in series form the conductive path. And a first end of the conductive path is coupled to ground via one of the first detect pins. A second end of the conductive path is coupled to the control unit via another one of the first detect pins.

22 Claims, 10 Drawing Sheets

(56) References Cited

U.S. PATENT DOCUMENTS

| | | | | |
|---|---|---|---|---|
| 2009/0130896 | A1* | 5/2009 | Cheng | H01R 13/6683 439/495 |
| 2009/0209811 | A1* | 8/2009 | Higuchi | G02B 23/2484 600/109 |
| 2009/0233459 | A1* | 9/2009 | Shiramizu | H05K 1/117 439/60 |
| 2013/0017732 | A1* | 1/2013 | Parke | H01R 13/641 439/660 |
| 2014/0170864 | A1* | 6/2014 | Hwang | H01R 13/6205 439/38 |
| 2016/0141809 | A1* | 5/2016 | Choi | H01R 13/6683 439/38 |
| 2016/0342373 | A1* | 11/2016 | Huang | G06F 3/1446 |
| 2018/0131207 | A1* | 5/2018 | Zhang | H02J 7/0029 |

* cited by examiner

ELECTRONIC DEVICE AND A METHOD FOR DETECTING THE CONNECTING DIRECTION OF TWO ELECTRONIC COMPONENTS

CROSS-REFERENCES TO RELATED APPLICATIONS

This application is a continuation of application Ser. No. 15/456,412, filed on Mar. 10, 2017, the entirety of which is hereby incorporated by reference.

BACKGROUND OF THE INVENTION

Field of the Invention

The present invention relates to electronic devices and, more particularly, to an electronic device with detection pins and a method for detecting connecting directions of two electronic components.

Description of the Prior Art

With portable electronic products (such as smartphones, tablets, and laptops) being lightweight and compact, they can be easily carried by users and operated in various places. Therefore, portable electronic products are technological products indispensable to people's life nowadays.

Due to technological advancements, various peripheral devices for use with portable electronic products are ever-changing and ever-increasing. For instance, a tablet is connected to an external keyboard which a user enters data into. The tablet is also connected to a charger to receive a mobile charge. A laptop is connected an external extended display which the other users watch.

A commercially available portable electronic product usually has its connector connected to a connector of a peripheral device so that the portable electronic product and the peripheral device can send signals to each other and thereby perform a related function. In general, both the connectors of the portable electronic product and the peripheral device have multiple functional pins (such as HDMI pins and USB pins) which match. However, even if the portable electronic product and the peripheral device are connected, the system of the portable electronic product cannot be detected whenever some functional pins (for example, the functional pins at one end of the connector) get disconnected or come into poor contact with each other under an external force (such as a vibration or a shake).

SUMMARY OF THE INVENTION

In view of the aforesaid drawbacks of the prior art, it is an objective of the present invention to provide an electronic device and a method for detecting connecting directions of two electronic components.

In an embodiment, an electronic device comprises a first electronic component and a second electronic component. The first electronic component comprises a control unit and a first connector. The first connector is coupled to the control unit and comprises a first pin unit. The first pin unit comprises an even number of first detection pins, and two of the first detection pins are disposed at two ends of the first connector, respectively. The second electronic component comprises a second connector which matches the first connector. The second connector comprises a second pin unit which comprises an even number of second detection pins corresponding in position to the first detection pins, respectively. When the first connector is electrically connected to the second connector, the first detection pins render the second detection pins conducting so as to form a conducting path which series-connects the first detection pins to the second detection pins. The conducting path has a first end coupled to a ground through one of the first detection pins. The conducting path has a second end coupled to the control unit through the other first detection pin.

In an embodiment, a method for detecting connecting directions of two electronic components comprises the steps of: sensing a grounded signal with a detection pin of a first connector; sending an address confirmation signal from a unit of signal pins of the first connector when the grounded signal is sensed; detecting for a response signal by the signal pins; confirming the response signal as one of a first address and a second address when the response signal is received; determining that the first connector is forward-connected to a second connector upon confirmation that the response signal is the first address; and determining that the first connector is reverse-connected to the second connector upon confirmation that the response signal is the second address.

In conclusion, an electronic device and a method for detecting connecting directions of two electronic components according to the present invention are adapted to confirm the state of connection of the first connector and the second connector through a conducting path whereby first detection pins of a first connector and second detection pins of a second connector are series-connected and timely detect that the first connector and the second connector are not connected, because of disconnection or poor contact, under an external force (such as a vibration or a shake); hence, the control unit carries out a subsequent security protection mechanism (to, for example, stop transmitting a signal or stop supplying power). In some embodiments, the electronic device and a method for detecting connecting directions of two electronic components according to the present invention are further adapted to determine whether the first connector and the second connector are connected and detect the connecting direction of the first connector and the second connector, through signal pins for detecting for a response signal.

DETAILED DESCRIPTION OF THE EMBODIMENTS

Figure 1:
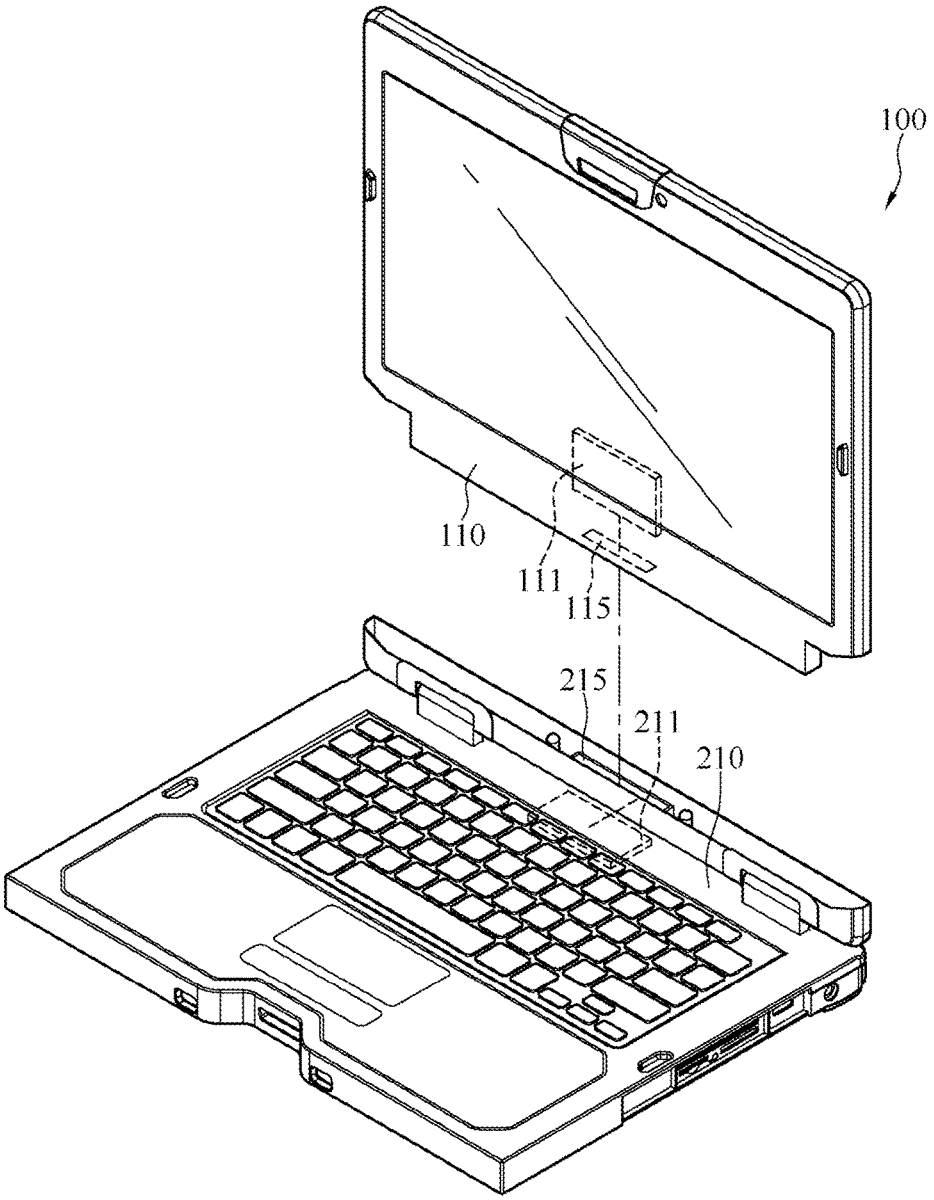
FIG. 1 is an exploded view of an electronic device according to the first embodiment of the present invention.

FIG. 1 is an exploded view of an electronic device according to the first embodiment of the present invention. Referring to FIG. 1, an electronic device 100 comprises two electronic components (hereinafter referred to as a first electronic component 110 and a second electronic component 210).

The first electronic component 110 comprises a control unit 111 and a first connector 115. The control unit 111 is disposed in the first electronic component 110 proper. The first connector 115 is disposed at an edge of the first electronic component 110 proper, mounted on the surface of the first electronic component 110 proper, and coupled to the control unit 111. The second electronic component 210 comprises a second connector 215. The second connector 215 is disposed at an edge of the second electronic component 210 proper and mounted on the surface of the second electronic component 210 proper. The second connector 215 and the first connector 115 match. Hence, the first connector 115 and the second connector 215 are directly and electrically coupled together, allowing the first electronic component 110 and the second electronic component 210 to communicate with each other. Therefore, the first electronic component 110 and the second electronic component 210 are connected through the first connector 115 and the second connector 215 (as shown in FIG. 2) and thus are not only electrically connected but can also send signals to each other.

In an embodiment, the electronic device 100 consists of a detachable laptop, a standalone electronic device (such as a cell phone, a smartphone, a tablet (iPad or Plant), a portable navigation device (PND), an IP cam, and a smart electrical appliance), and its peripheral device (such as a charger, an extended display, an external hard disk drive, a speaker, an external keyboard, a stylus, and/or a signal socket. For instance, the first electronic component 110 is a tablet, whereas the second electronic component 210 is an external keyboard. When the first connector 115 of the tablet is connected to the second connector 215 of an external keyboard, the external keyboard can control the tablet. In an embodiment, the control unit 111 of the first electronic component 110 is a microprocessor, a microcontroller, a digital signal processor, a microcomputer, a central processing unit, a field-programmable gate array, or a logic circuit.

The first connector 115 comprises a first pin unit 116. The first pin unit 116 has an even number of first detection pins 1161 (for example, two, four or six first detection pins 1161). Two of the first detection pins 1161 are disposed at two ends of the first connector 115, respectively. The second connector 215 comprises a second pin unit 216. The second pin unit 216 has an even number of second detection pins 2161 corresponding in position to the first detection pins 1161, respectively. When the first connector 115 is electrically connected to the second connector 215, the first detection pins 1161 render the second detection pins 2161 conducting so as to form a conducting path. The conducting path series-connects the first detection pins 1161 to the second detection pins 2161. The conducting path has a first end coupled to a ground G through one of the first detection pins 1161. The conducting path has a second end coupled to the control unit 111 of the first electronic component 110 through the other first detection pin 1161. The present invention is hereunder described with different embodiments. In some embodiments, the first pin unit 116 has more pins than the first detection pins 1161, that is, the first detection pins 1161 are K specific pins of the M first pin unit 116. Both M and K are positive integers, with M larger than K, and K is an even number. The second pin unit 216 has more pins than the second detection pins 2161. The second detection pins 2161 equal the first detection pins 1161 in quantity.

Figure 2:
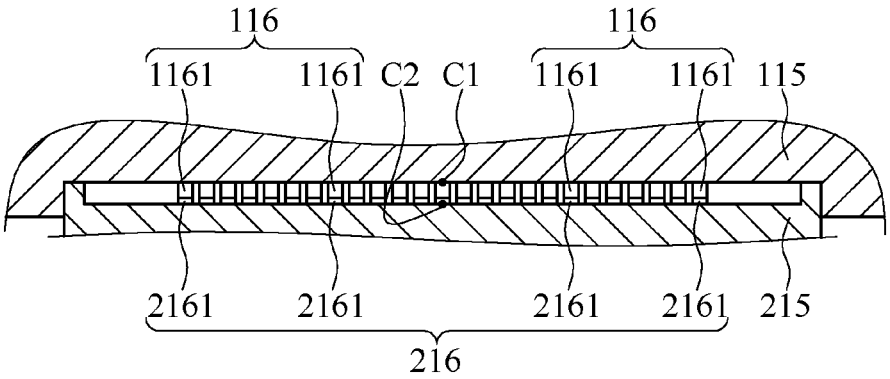
FIG. 2 is a partial cross-sectional view of the electronic device according to the first embodiment of the present invention.
Figure 3:
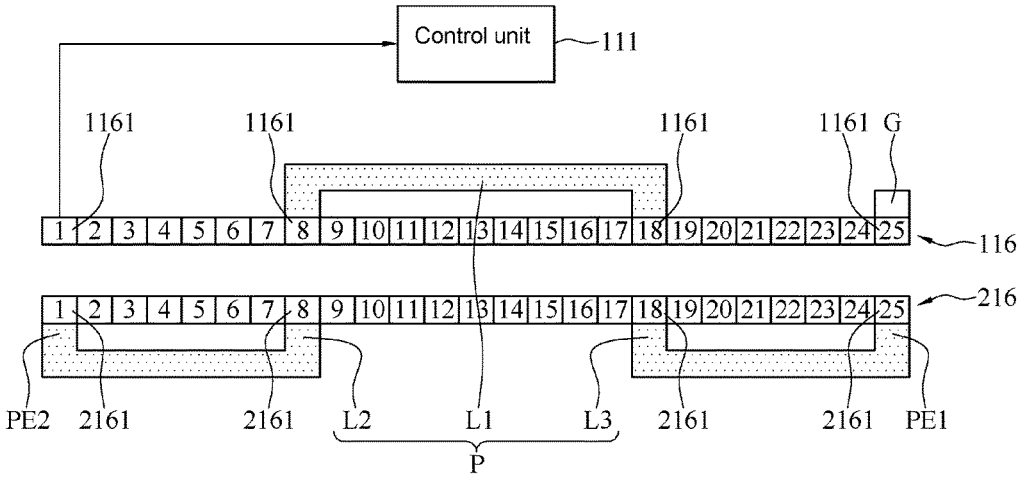
FIG. 3 is a schematic view of the circuit of the electronic device according to the first embodiment of the present invention.

FIG. 2 is a partial cross-sectional view of the electronic device according to the first embodiment of the present invention. FIG. 3 is a schematic view of the circuit of the electronic device according to the first embodiment of the present invention. For illustrative sake, the first embodiment of the present invention is exemplified by the first pin unit 116 and the second pin unit 216, wherein the first pin unit 116 has 25 pins, four of which are first detection pins 1161, and the second pin unit 216 has 25 pins, four of which are second detection pins 2161. Referring to FIG. 2 and FIG. 3, in an embodiment, the first pin unit 116 comprises 25 pins (hereinafter referred to as first pins numbers 1~25) arranged in sequence, whereas the second pin unit 216 also comprises 25 pins (hereinafter referred to as second pins numbers 1~25) arranged in sequence. The first pin unit 116 comprises four first detection pins 1161 (for example, the first pins numbers 1, 8, 18, 25 shown in the diagram are the first detection pins 1161), whereas the second pin unit 216 comprises four second detection pins 2161 (for example, the second pins numbers 1, 8, 18, 25 shown in the diagram are the second detection pins 2161) corresponding in position to the first detection pins 1161. The first detection pins 1161 numbers 1, 25 are the pins closest to the two ends of the first connector 115 in the first pin unit 116. The first detection pin 1161 number 1 is coupled to the control unit 111 of the first electronic component 110 (for example, the first detection pin 1161 number 1 is electrically connected to the control unit 111 through a circuit), and the first detection pin 1161 number 25 is coupled to the ground G. Moreover, in this embodiment, the first detection pins 1161 numbers 8, 18 are electrically connected (for example, electrically connected by a conducting line L1). Moreover, the second detection pins 2161 numbers 1, 8 are electrically connected (for example, electrically connected by a conducting line L2), and the second detection pins 2161 numbers 18, 25 are electrically connected (for example, electrically connected by a conducting line L3). Therefore, when the first connector 115 is connected to the second connector 215, the first detection pins 1161 and the second detection pins 2161 are series-connected by the conducting lines L1, L2, L3 and thus rendered conducting, so as to form a conducting path P. The conducting path P has a first end PE1 coupled to the ground G through the first detection pin 1161 number 25. The conducting path P has a second end PE2 coupled to the control unit 111 of the first electronic component 110 through the first detection pin 1161 number 1 so that the control unit 111 of the first electronic component 110 senses a signal from the ground G through the conducting path P.

Hence, the conducting path P substantially passes through the first connector 115 entirely and the second connector 215 entirely. Therefore, if the pins series-connected along the conducting path P get disconnected or come into poor contact with each other under an external force (such as a vibration or a shake) while the electronic device 100 is in use, the control unit 111 cannot sense at one end of the conducting path P the grounded signal from the other end of the conducting path P, thereby detecting that the pins have got disconnected or come into poor contact with each other; hence, the control unit 111 carries out a subsequent security protection mechanism (to, for example, stop transmitting a signal or stop supplying power), so as to ensure that the first connector 115 and the second connector 215 are connected.

Figure 4:
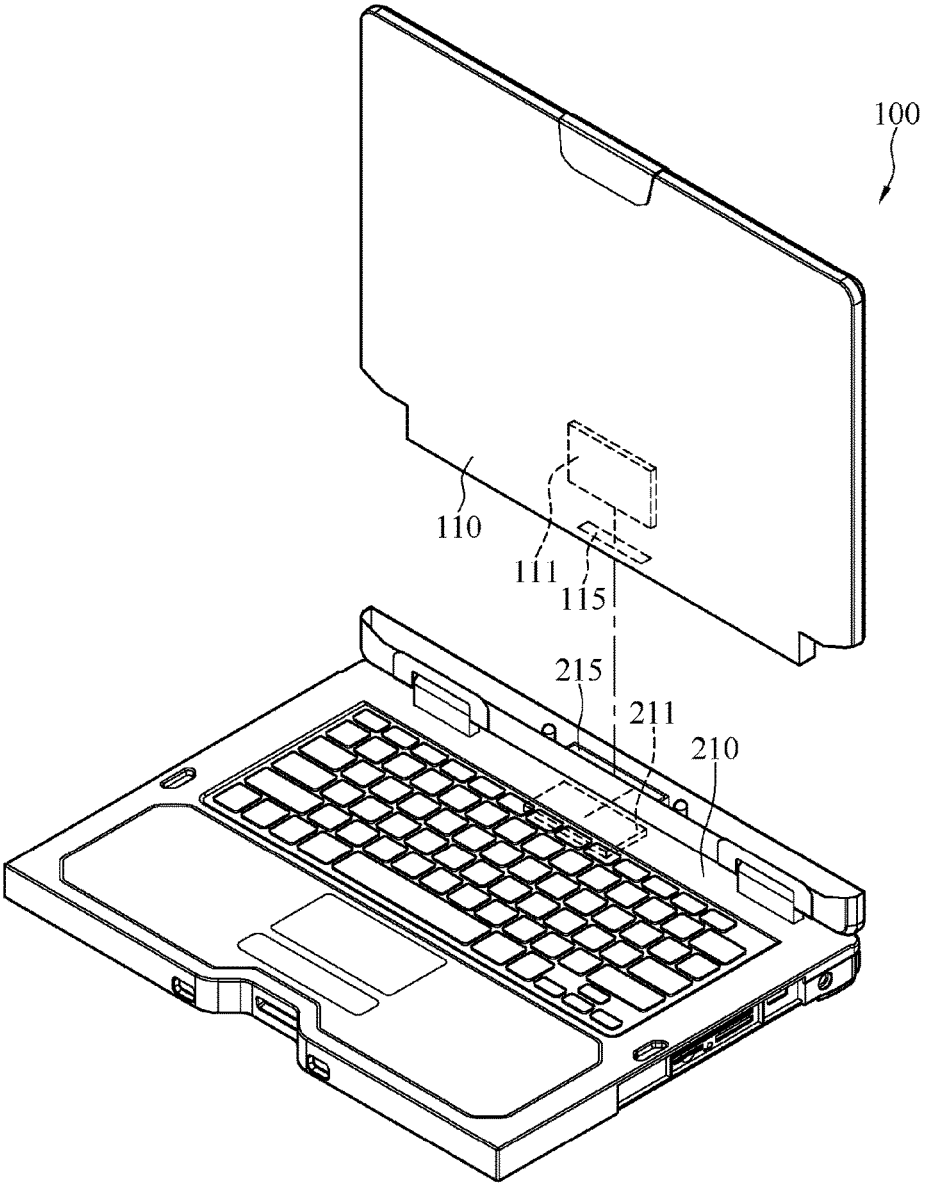
FIG. 4 is another exploded view of the electronic device according to the first embodiment of the present invention.

Referring to FIG. 2 and FIG. 3, in an embodiment, the first detection pins 1161 of the first pin unit 116 are arranged symmetrically about center C1 of the first connector 115. After the first connector 115 has rotated by 180 degrees about center C1, the positions of the pins of the first pin unit 116 overlap the pre-rotation positions of the pins of the first pin unit 116, respectively. The second detection pins 2161 of the second pin unit 216 are arranged symmetrically about center C2 of the second connector 215. After the second connector 215 has rotated by 180 degrees about center C2, the positions of the pins of the second pin unit 216 overlap the pre-rotation positions of the pins of the second pin unit 216, respectively. Therefore, regardless of whether the first connector 115 is forward-connected to the second connector 215 (as shown in FIG. 1) or reverse-connected to the second connector 215 (as shown in FIG. 4), both the first detection pins 1161 and the second detection pins 2161 can be series-connected so as to form the conducting path P, allowing the control unit 111 of the first electronic component 110 to sense a signal from the ground G through the conducting path P.

Moreover, the pins at the two ends of the first connector 115 and the second connector 215 are likely to be disconnected when the electronic device 100 is subjected to an external force. Therefore, in this embodiment of the present invention, two first detection pins 1161 of the first pin unit 116 are disposed at the two ends of the first connector 115, respectively, to preclude the situation where disconnection of pins occurs but is not detected by the control unit 111, thereby enhancing sensing accuracy.

Figure 5:
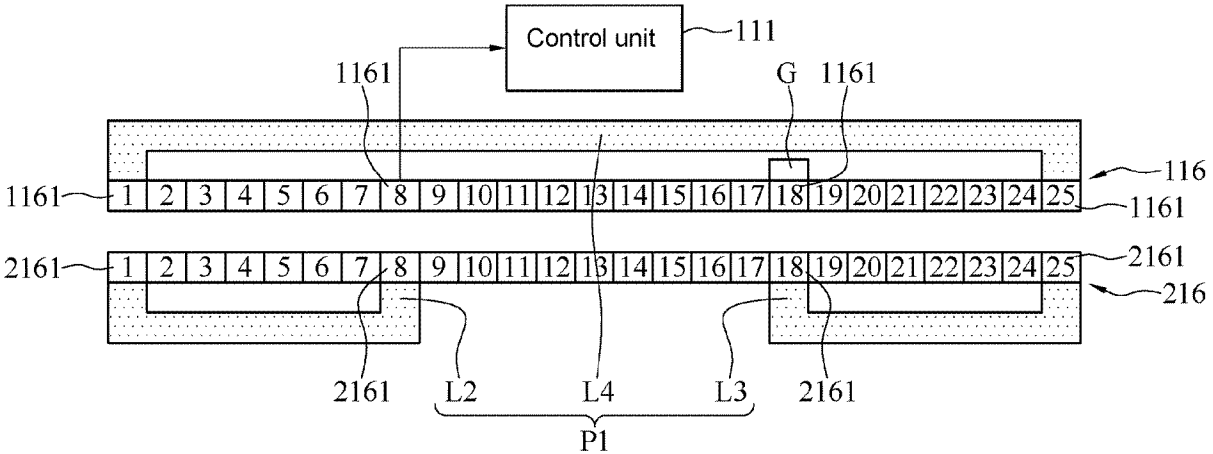
FIG. 5 is a schematic view of the circuit of the electronic device according to the second embodiment of the present invention.

FIG. 5 is a schematic view of the circuit of the electronic device according to the second embodiment of the present invention. The second embodiment of FIG. 5 is distinguished from the first embodiment of FIG. 3 by: the first detection pins 1161 numbers 1, 25 of the first pin unit 116 are electrically connected (for example, electrically connected by a conducting line L4); the first detection pin 1161 number 8 of the first pin unit 116 is coupled to the control unit 111 of the first electronic component 110; and the first detection pin 1161 number 18 of the first pin unit 116 is coupled to the ground G. Therefore, when the first connector 115 is connected to the second connector 215, the first detection pins 1161 and the second detection pins 2161 are series-connected by the conducting lines L2, L3, L4 and thus rendered conducting, so as to form another conducting path P1, thereby allowing the control unit 111 of the first electronic component 110 to sense a signal from the ground G through the conducting path P1.

Figure 6:
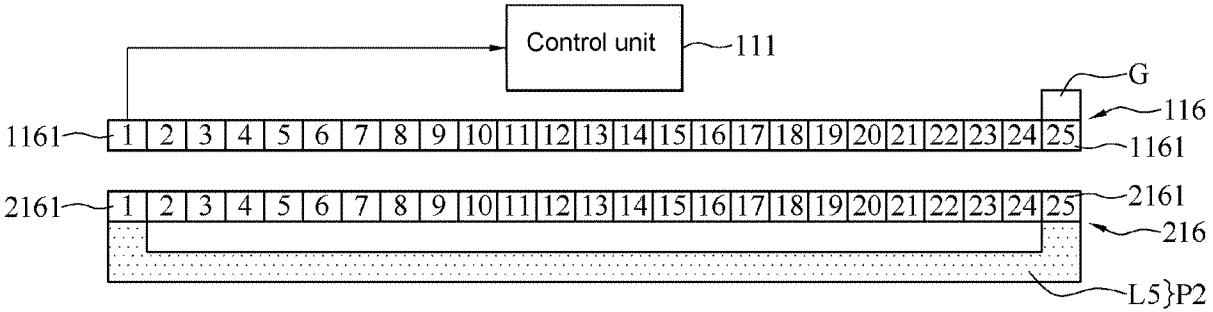
FIG. 6 is a schematic view of the circuit of the electronic device according to the third embodiment of the present invention.

FIG. 6 is a schematic view of the circuit of the electronic device according to the third embodiment of the present invention. Referring to FIG. 6, in the third embodiment, the first pin unit 116 comprises only two first detection pins 1161 (such as the first pins numbers 1, 25 as shown in the diagram) coupled to the control unit 111 and the ground G, respectively. The second pin unit 216 comprises two second detection pins 2161 (such as the second pins numbers 1, 25 shown in the diagram) corresponding in position to two first detection pins 1161, and two second detection pins 2161 electrically connected (for example, electrically connected by a conducting line L5). Therefore, when the first connector 115 is connected to the second connector 215, the first detection pins 1161 and the second detection pins 2161 are series-connected by the conducting line L5 and thus rendered conducting, so as to form yet another conducting path P2, thereby allowing the control unit 111 of the first electronic component 110 to sense a signal from the ground G through the conducting path P2. Moreover, in this embodiment, two second detection pins 2161 are series-connected solely by the conducting line L5 to form the conducting path P2, so as to achieve the advantage of simplifying circuits and processes.

Figure 9:
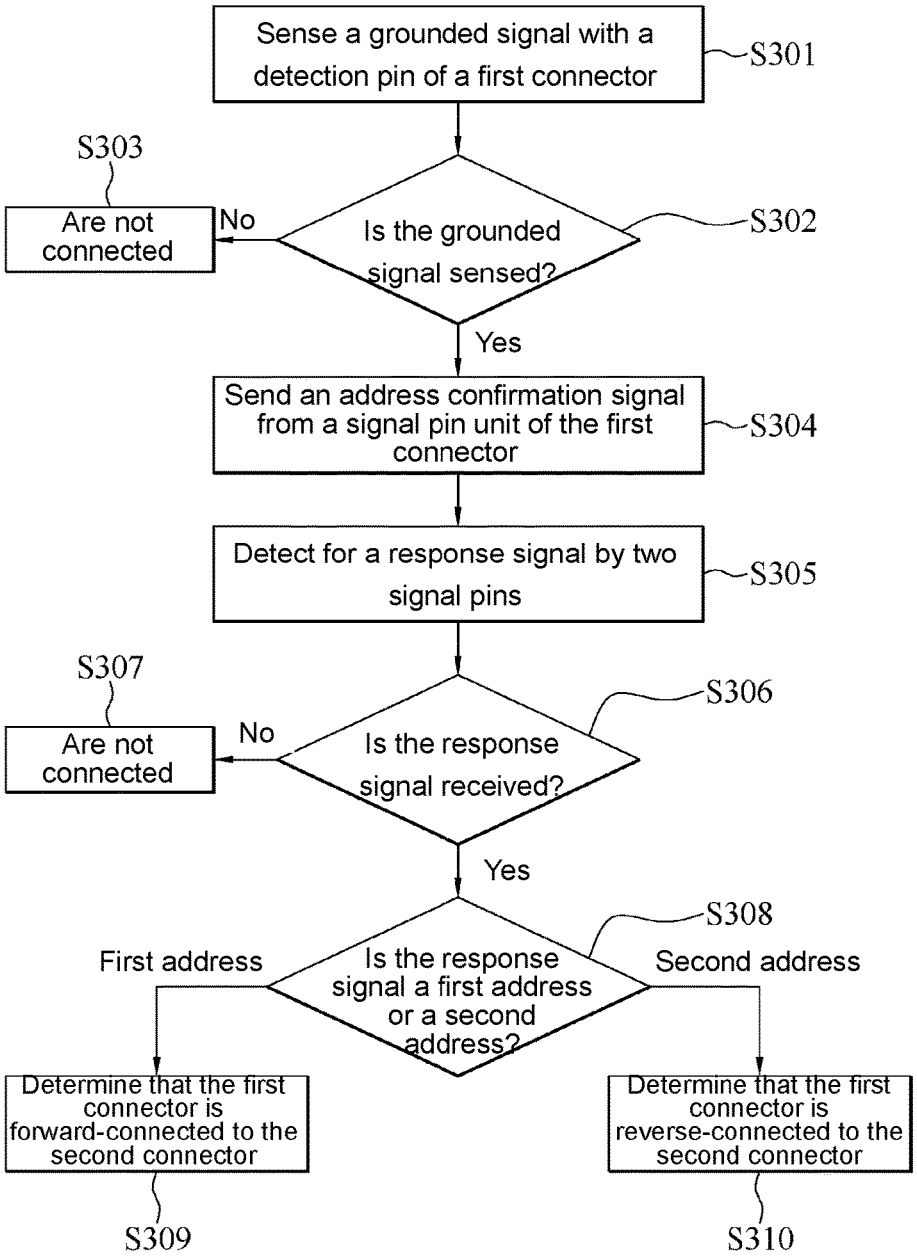
FIG. 9 is a flowchart of a method for detecting connecting directions of two electronic components according to an embodiment of the present invention.

FIG. 9 is a flowchart of a method for detecting connecting directions of two electronic components according to an embodiment of the present invention. Referring to FIG. 9, to detect whether the first connector 115 of the first electronic component 110 is connected to the second connector 215 of the second electronic component 210, a detection pin of the first connector 115 senses a grounded signal (step S301) to determine the state of connection of the first connector 115 and the second connector 215 according to whether the grounded signal is sensed (step S302). For instance, when the detection pin has not sensed the grounded signal, it is determined that the first connector 115 and the second connector 215 are not connected (step S303). Conversely, when the detection pin senses the grounded signal, it is determined that the first connector 115 and the second connector 215 are connected and proceeds to subsequent steps.

In an embodiment, the way of sensing the grounded signal is identical to the ones disclosed in the aforesaid embodiments and described as follows: after the first connector 115 is electrically connected to the second connector 215, the first detection pins 1161 render the second detection pins 2161 conducting so as to form a conducting path P; the first end PE1 of the conducting path P is coupled to the ground G through one of the first detection pins 1161; the second end PE2 of the conducting path P is coupled to the control unit 111 of the first electronic component 110 through the other first detection pin 1161; hence, the control unit 111 of the first electronic component 110 senses a signal from the ground G through the conducting path P.

Figure 7:
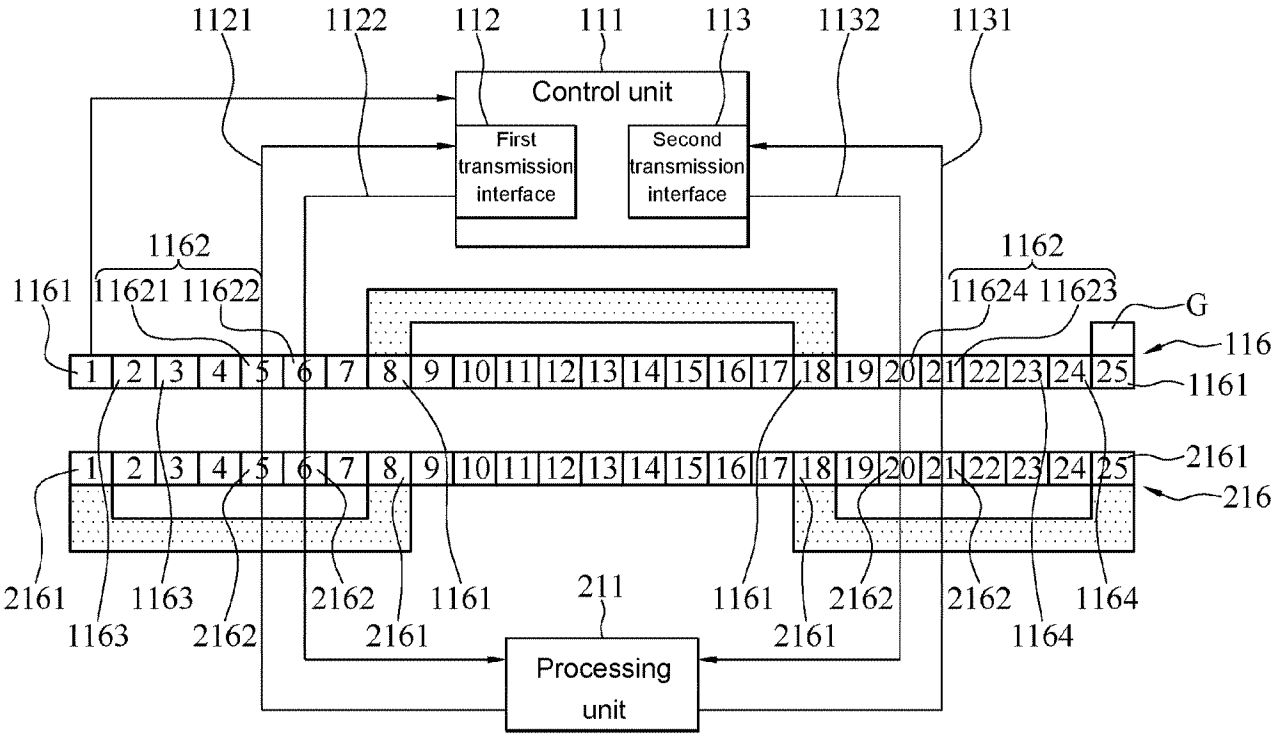
FIG. 7 is a schematic view of the circuit of the electronic device according to the fourth embodiment of the present invention.

Referring to FIG. 7, to detect whether the first connector 115 is forward-connected or reverse-connected to the second connector 215, when a detection pin of the first connector 115 senses the grounded signal, a unit of signal pins of the first connector 115 send an address confirmation signal (step S304). The unit of signal pins detect for a response signal (step S305) and determine whether the response signal is received (step S306). When the signal pins do not receive the response signal, it is determined that the first connector 115 and the second connector 215 are not connected (step S307). Conversely, when the signal pins receive the response signal, it is determined that the first connector 115 and the second connector 215 are connected and proceeds to subsequent steps.

Referring to FIG. 7, in an embodiment, the first pin unit 116 of the first connector 115 comprises at least two signal pins 1162. The control unit 111 sends through the two signal pins 1162 an address confirmation signal to a processing unit 211 coupled to the second connector 215. The processing unit 211 sends a response signal in response to the address confirmation signal. In some embodiments, the processing unit 211 is a microprocessor, a microcontroller, a digital signal processor, a microcomputer, a central processing unit, a field-programmable gate array, or a logic circuit. In some embodiments, the processing unit 211 sends a response signal through at least two transmitting pins 2162 which connect with the two signal pins 1162.

Referring to FIG. 9, when the two signal pins receive the response signal, it is determined that the response signal is a first address or a second address (step S308). When the response signal is the first address, it is determined that the first connector 115 is forward-connected to the second connector 215 (step S309). When the response signal is the second address, it is determined that the first connector 115 is reverse-connected to the second connector 215 (step S310). For instance, referring to FIG. 1 and FIG. 4, FIG. 1 shows that the first connector 115 is forward-connected to the second connector 215, allowing the electronic device 100 to function as a laptop, and FIG. 4 shows that the first connector 115 is reverse-connected to the second connector 215, allowing the electronic device 100 to function as a display. In this embodiment of the present invention, by determining the address of the response signal, it is feasible to determine whether the first connector 115 is forward-connected to the second connector 215 or reverse-connected to the second connector 215.

Referring to FIG. 7, in an embodiment of this present invention, the control unit 111 comprises two transmission interfaces (hereinafter referred to as a first transmission interface 112 and a second transmission interface 113). One of the two signal pins 1162 is coupled to the first transmission interface 112 and comprises a first input pin 11621 and a first output pin 11622. The other signal pin 1162 is coupled to the second transmission interface 113 and comprises a second input pin 11623 and a second output pin 11624. The control unit 111 uses the first output pin 11622 and the second output pin 11624 to output the address confirmation signal, and uses the first input pin 11621 and the second input pin 11623 to receive the response signal from the processing unit 211. In an embodiment, if the response signal received by the first input pin 11621 is address 0, and the response signal received by the second input pin 11623 is address 1, the control unit 111 will determine that the first connector 115 is forward-connected to the second connector 215. Conversely, if the response signal received by the first input pin 11621 is address 1, and the response signal received by the second input pin 11623 is address 0, the control unit 111 will determine that the first connector 115 is reverse-connected to the second connector 215.

Furthermore, assuming that the first input pin 11621 or the second input pin 11623 does not receive the response signal, the control unit 111 determines that the first connector 115 and the second connector 215 are not connected; hence, the control unit 111 carries out a subsequent security protection mechanism (to, for example, stop transmitting a signal or stop supplying power). Therefore, after the control unit 111 has sensed a signal from the ground G through the conducting path P, the two signal pins 1162 sense whether the first connector 115 and the second connector 215 are connected, thereby enhancing determination accuracy.

In an embodiment, the first transmission interface 112 is an $I^2C$ interface and is electrically connected to the first input pin 11621 and the first output pin 11622 through a first serial signal line 1121 and a first serial clock line 1122, respectively. The second transmission interface 113 is an $I^2C$ interface and is electrically connected to the second input pin 11623 and the second output pin 11624 through a second serial signal line 1131 and a second serial clock line 1132, respectively. In the embodiments of the present invention, with the first and second transmission interfaces 112, 113 being $I^2C$ interfaces, it is feasible to simplify circuits and enhance transmission efficiency, so as to enable the control unit 111 to make judgment quickly.

In an embodiment, the two signal pins 1162 include only a first input pin 11621 and a first output pin 11622, whereas the control unit 111 instructs the first output pin 11622 to send an address confirmation signal and the first input pin 11621 to receive the response signal from the second electronic component 210. In an embodiment, when the response signal received by the first input pin 11621 is address 0, the control unit 111 confirms that the response signal is the first address and determines that the first connector 115 is forward-connected to the second connector 215. Conversely, when the response signal received by the first input pin 11621 is address 1, the control unit 111 confirms that the response signal is the second address and determines that the first connector 115 is reverse-connected to the second connector 215.

Figure 10:
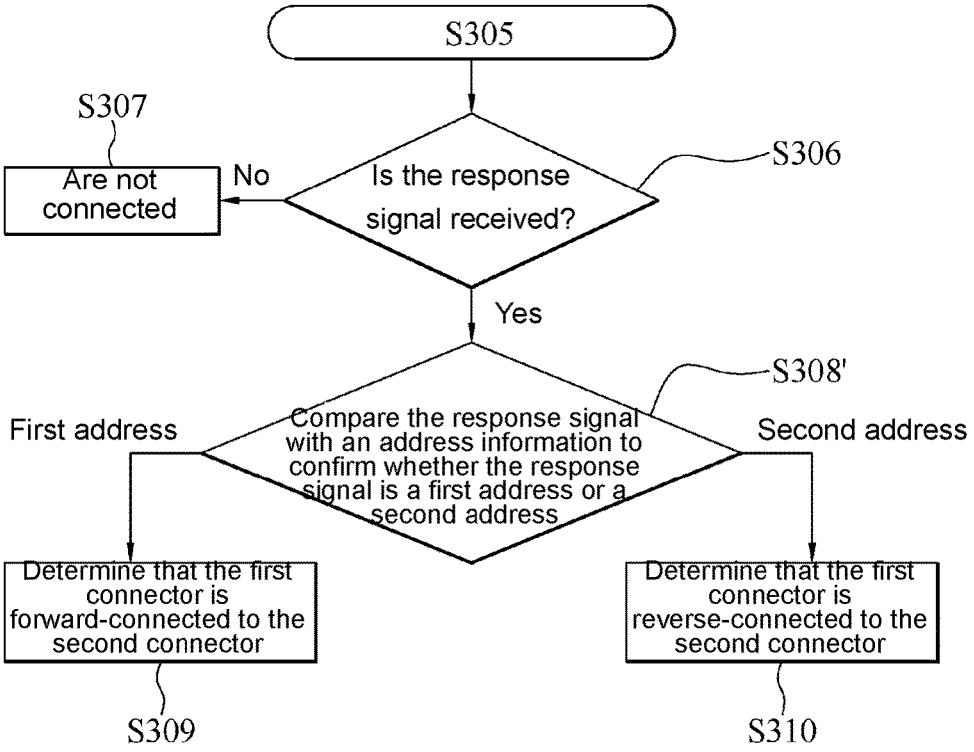
FIG. 10 is a flowchart of the method for detecting connecting directions of two electronic components according to another embodiment of the present invention.

FIG. 10 is a flowchart of the method for detecting connecting directions of two electronic components according to another embodiment of the present invention. Referring to FIG. 10, in an embodiment, the control unit 111 compares the response signal with an address information to confirm the response signal as the first address or the second address (step S 308'). Hence, the control unit 111 compares the response signal with the address information, so as to confirm the response signal as the first address when the response signal conforms with the address information and confirm the response signal as the second address when the response signal does not conform with the address information. For instance, the control unit 111 predetermines an address information (for example, address 0) so as to determine that the response signal conforms with the address information and thus confirms the response signal as the first address when the response signal is address 0, and determine that the response signal does not conform with the address information and thus confirms the response signal as the second address when the response signal is address 1.

Figure 11:
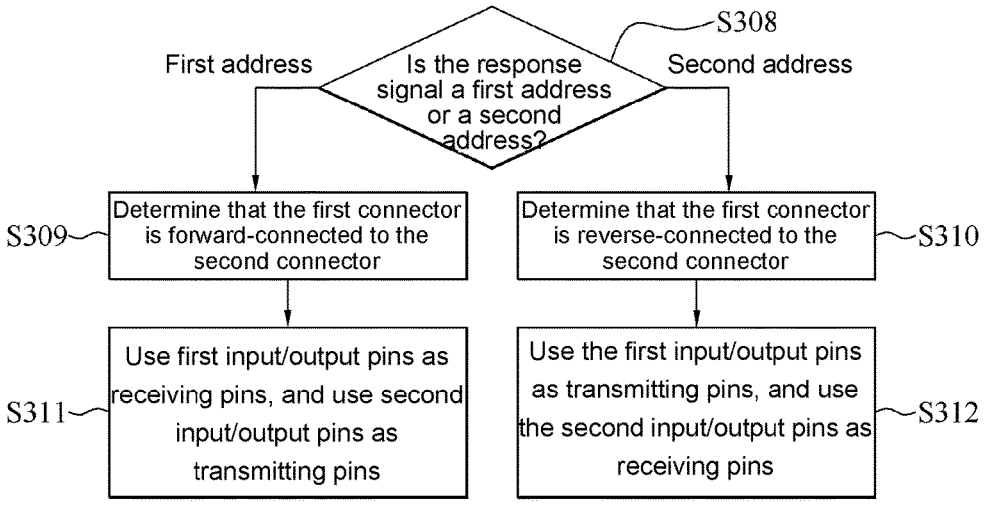
FIG. 11 is a flowchart of the method for detecting connecting directions of two electronic components according to yet another embodiment of the present invention.

FIG. 11 is a flowchart of the method for detecting connecting directions of two electronic components according to yet another embodiment of the present invention. Referring to FIG. 11, in an embodiment, when the response signal is the first address, it is determined that the first connector 115 is forward-connected to the second connector 215 (step S309); afterward, the control unit 111 uses two first input/output pins as the receiving pins and uses the two second input/output pins as the transmitting pins (step S311). When the response signal is the second address, it is determined that the first connector 115 is reverse-connected to the second connector 215 (step S310); afterward, the control unit 111 uses the two first input/output pins as the transmitting pins and uses the two second input/output pins as the receiving pins (step S312).

Referring to FIG. 7, in an embodiment, the first pin unit 116 of the first connector 115 comprises two first input/output pins 1163 and two second input/output pins 1164. When the control unit 111 determines that the first connector 115 is forward-connected to the second connector 215, the control unit 111 uses the two first input/output pins 1163 as the receiving pins and uses the two second input/output pins 1164 as the transmitting pins. When the control unit 111 determines that the first connector 115 is reverse-connected to the second connector 215, the control unit 111 uses the two first input/output pins 1163 as the transmitting pins and uses the two second input/output pins 1164 as the receiving pins.

Referring to FIG. 7, in an embodiment, assuming that the first pins numbers 2, 3 of the first pin unit 116 are two first input/output pins 1163, and the two first input/output pins 1163 function as signal transmitting pins (such as USB 3.0 TX +/−) or receiving pins (such as USB 3.0 RX +/−) of USB 3.0. Assuming that the first pins numbers 23, 24 of the first pin unit 116 are two second input/output pins 1164, and the two second input/output pins 1164 function as signal transmitting pins (such as USB 3.0 TX +/−) or receiving pins (such as USB 3.0 RX +/−) of USB 3.0. In an embodiment, preferably, the two first input/output pins 1163 and the two second input/output pins 1164 are arranged symmetrically about the center of the first connector 115.

Figure 8:
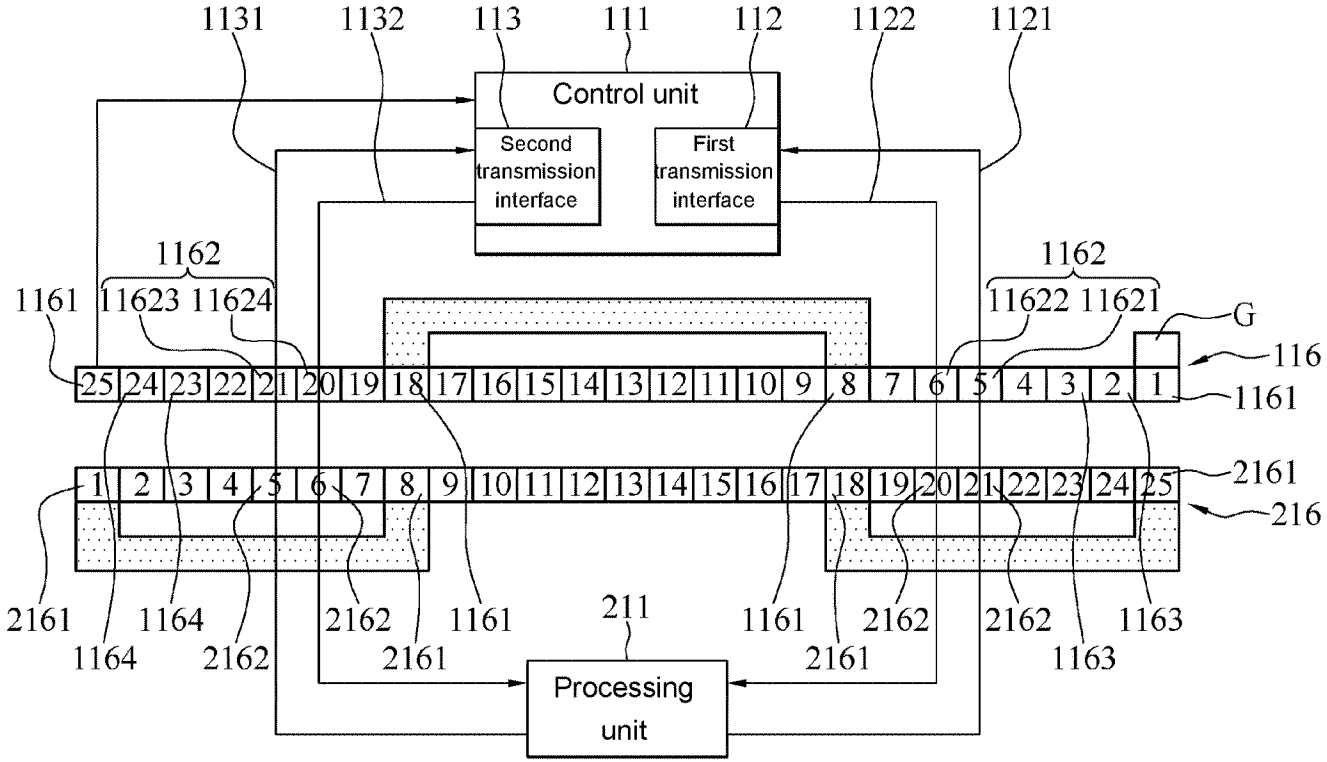
FIG. 8 is a schematic view of the circuit of the electronic device according to the fifth embodiment of the present invention.

Referring to FIG. 1 and FIG. 7, when the first connector 115 is forward-connected to the second connector 215, the two first input/output pins 1163 are connected to the second pins numbers 2, 3 of the second pin unit 216 (assuming that the second pins numbers 2, 3 are USB 3.0 TX +/−), whereas the two second input/output pins 1164 are connected to the second pins numbers 23, 24 of the second pin unit 216 (assuming that the second pins numbers 23, 24 are USB 3.0 RX +/−). After the control unit 111 has determined that the first connector 115 is forward-connected to the second connector 215, the control unit 111 uses the two first input/output pins 1163 as the signal receiving pins (USB 3.0 RX +/−) and uses the two second input/output pins 1164 as the signal transmitting pins (USB 3.0 TX +/−) so as to send USB 3.0 signals to each other. Referring to FIG. 4 and FIG. 8, when the first connector 115 is reverse-connected to the second connector 215, the two first input/output pins 1163 are connected to the second pins numbers 23, 24 of the second pin unit 216, whereas the two second input/output pins 1164 are connected to the second pins numbers 2, 3 of the second pin unit 216. After the control unit 111 has determined that the first connector 115 is reverse-connected to the second connector 215, the control unit 111 uses the two first input/output pins 1163 as the signal transmitting pins (USB 3.0 TX +/−) and uses the two second input/output pins 1164 as the signal receiving pins (USB 3.0 RX +/−), to prevent input/output conflicts which might otherwise lead to an unstable logic state.

Figure 12:
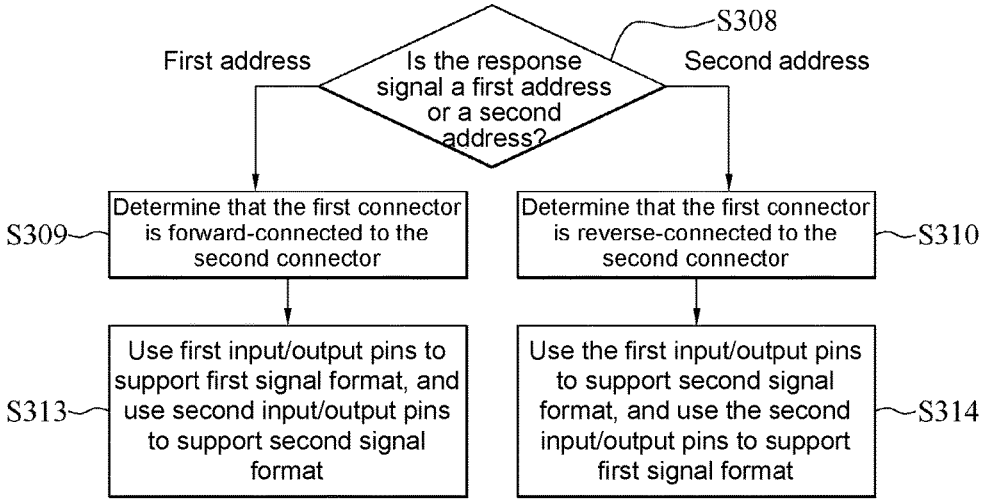
FIG. 12 is a flowchart of the method for detecting connecting directions of two electronic components according to still yet another embodiment of the present invention.

FIG. 12 is a flowchart of the method for detecting connecting directions of two electronic components according to still yet another embodiment of the present invention. After the control unit 111 has determined that the first connector 115 is forward-connected to the second connector 215 (step S309), the control unit 111 uses the two first input/output pins to support first signal format and uses the two second input/output pins to support second signal format (step S313). After the control unit 111 has determined that the first connector 115 is reverse-connected to the second connector 215 (step S310), the control unit 111 uses the two first input/output pins to support second signal format and uses the two second input/output pins to support first signal format (step S314).

For instance, as shown in FIG. 7, assuming that the first pins numbers 2, 3 of the first pin unit 116 are the two first input/output pins 1163, the two first input/output pins 1163 are used as the signal transmitting pins capable of supporting USB 2.0 format (such as USB 2.0+/−) or $I^2C$ (inter-integrated circuit) format. Assuming that the first pins numbers 23, 24 of the first pin unit 116 are the two second input/output pins 1164, the two second input/output pins 1164 are used as the signal transmitting pins capable of supporting USB 2.0 format (such as USB 2.0+/−) or $I^2C$ (inter-integrated circuit) format. Assuming that the second pins numbers 2, 3 of the second pin unit 216 are signal transmitting pins of USB 2.0 format, the second pins numbers 23, 24 of the second pin unit 216 are signal transmitting pins of $I^2C$ format. In an embodiment, preferably, the two first input/output pins 1163 and the two second input/output pins 1164 are arranged symmetrically about the center of the first connector 115.

Referring to FIG. 1 and FIG. 7, when the first connector 115 is forward-connected to the second connector 215, the two first input/output pins 1163 are connected to the second pins numbers 2, 3 of the second pin unit 216, whereas the two second input/output pins 1164 are connected to the second pins numbers 23, 24 of the second pin unit 216. After the control unit 111 has determined that the first connector 115 is forward-connected to the second connector 215, the control unit 111 uses the two first input/output pins 1163 to support USB 2.0 format and thus conform with the format of the second pins numbers 2, 3 of the second pin unit 216. Hence, the control unit 111 uses the two second input/output pins 1164 to support $I^2C$ format and thus conform with the format of the second pins numbers 23, 24 of the second pin unit 216 so as to send/receive USB 2.0 signals and $I^2C$ signals to/from each other. Conversely, as shown in FIG. 4 and FIG. 8, when the first connector 115 is reverse-connected to the second connector 215, the two first input/output pins 1163 are connected to the second pins numbers 23, 24 of the second pin unit 216, whereas the two second input/output pins 1164 are connected to the second pins numbers 2, 3 of the second pin unit 216. After the control unit 111 has determined that the first connector 115 is reverse-connected to the second connector 215, the control unit 111 uses the two first input/output pins 1163 to support $I^2C$ format and uses the two second input/output pins 1164 to support USB 2.0 format, to prevent input/output conflicts which might otherwise lead to an unstable logic state.

In conclusion, an electronic device and a method for detecting connecting directions of two electronic components according to the present invention are adapted to confirm the state of connection of the first connector and the second connector through a conducting path whereby first detection pins of a first connector and second detection pins of a second connector are series-connected and timely detect that the first connector and the second connector are not connected, because of disconnection or poor contact, under an external force (such as a vibration or a shake); hence, the control unit carries out a subsequent security protection mechanism (to, for example, stop transmitting a signal or stop supplying power). In some embodiments, the electronic device and a method for detecting connecting directions of two electronic components according to the present invention are further adapted to determine whether the first connector and the second connector are connected and detect the connecting direction of the first connector and the second connector, through signal pins for detecting for a response signal.

Although the present invention is disclosed above by preferred embodiments, the preferred embodiments are not restrictive of the present invention. Changes and modifications made by persons skilled in the art to the preferred embodiments without departing from the spirit of the present invention must be deemed falling within the scope of the present invention. Accordingly, the legal protection for the present invention should be defined by the appended claims.

What is claimed is:

1. An electronic device, comprising:

a first electronic component comprising a control unit and a first connector, the first connector being coupled to the control unit and comprising a first pin unit, the first pin unit comprising an even number of first detection pins; and a second electronic component comprising a second connector which matches the first connector, the second connector comprising a second pin unit, the second pin unit comprising an even number of second detection pins corresponding in position to the first detection pins, respectively;

wherein, when the first connector is electrically connected to the second connector, the first detection pins and the second detection pins form a conducting path, wherein the conducting path series-connects the first detection pins to the second detection pins, wherein the conducting path has a first end coupled to a ground through a first one of the first detection pins and a second end coupled to the control unit through a second one of the first detection pins.

2. The electronic device of claim 1, wherein the first connector further comprises a first conducting line coupling two other ones of the first detection pins, the second connector comprises a second conducting line and a third conducting line, each coupled between two of the second detection pins, and when the first connector is connected to the second connector, the conducting path series-connects the first, second and third conducting lines.

3. The electronic device of claim 2, wherein the two other ones of the first detection pins are disposed at the two ends of the first connector, respectively.

4. The electronic device of claim 1, wherein the second connector comprises a conducting line coupled between a first one of second detection pins and a second one of the second detection pins, and when the first connector is connected to the second connector, the first one of the first detection pins is coupled to the first one of the second detection pins, and the second one of the first detection pins is coupled to the second one of the second detection pins.

5. The electronic device of claim 1, wherein the first pin unit comprises two signal pins whereby the control unit sends an address confirmation signal to the second electronic component when the control unit senses a signal from the ground through the conducting path, and the control unit determines whether the first connector is forward-connected or reverse-connected to the second connector according to a response signal generated from the second electronic component in response to the address confirmation signal.

6. The electronic device of claim 5, wherein the first pin unit comprises two first input/output pins and two second input/output pins such that the control unit uses the two first input/output pins as receiving pins and the two second input/output pins as transmitting pins upon determination that the first connector is forward-connected to the second connector, and uses the two first input/output pins as transmitting pins and the two second input/output pins as receiving pins upon determination that the first connector is reverse-connected to the second connector.

7. The electronic device of claim 6, wherein the two first input/output pins and the two second input/output pins are arranged symmetrically about a center of the first connector.

8. The electronic device of claim 5, wherein the first pin unit comprises two first input/output pins and two second input/output pins such that the control unit uses the two first input/output pins to support first signal format and the two second input/output pins to support second signal format upon determination that the first connector is forward-connected to the second connector, and uses the two first input/output pins to support second signal format and the two second input/output pins to support first signal format upon determination that the first connector is reverse-connected to the second connector.

9. The electronic device of claim 8, wherein the two first input/output pins and the two second input/output pins are arranged symmetrically about a center of the first connector.

10. The electronic device of claim 5, wherein the second electronic component comprises a processing unit coupled to the second connector, and the processing unit sends the response signal through two transmitting pins attributed to the second pin unit and connected to the signal pins.

11. The electronic device of claim 5, wherein the control unit comprises a transmission interface, and the signal pins comprise an input pin and an output pin which are coupled to the transmission interface.

12. The electronic device of claim 11, wherein the transmission interface is an $I^2C$ interface electrically connected to the signal pins through a serial signal line and a serial clock line, respectively.

13. The electronic device of claim 5, wherein the control unit comprises a first transmission interface and a second transmission interface such that one of the two signal pins is coupled to the first transmission interface and comprises a first input pin and a first output pin, and another one of the two signal pins is coupled to the second transmission interface and comprises a second input pin and a second output pin.

14. The electronic device of claim 13, wherein the two signal pins are arranged symmetrically about a center of the first connector.

15. The electronic device of claim 13, wherein the first transmission interface is an $I^2C$ interface electrically connected to the first input pin and the first output pin through a first serial signal line and a first serial clock line, respectively, whereas the second transmission interface is an $I^2C$ interface electrically connected to the second input pin and the second output pin through a second serial signal line and a second serial clock line, respectively.

16. The electronic device of claim 1, wherein the first detection pins are arranged symmetrically about a center of the first connector.

17. A method for detecting connecting directions of two electronic components, comprising the steps of:

sending an address confirmation signal from signal pins of a first connector;

detecting for a response signal by the signal pins;

confirming the response signal as one of a first address and a second address when the response signal is received;

determining that the first connector is forward-connected to a second connector upon confirmation that the response signal is the first address; and determining that the first connector is reverse-connected to the second connector upon confirmation that the response signal is the second address.

18. The method of claim 17, wherein the response signal is sent from a processing unit coupled to the second connector.

19. The method of claim 18, wherein the processing unit sends the response signal through two transmitting pins connected to the signal pins.

20. The method of claim 17, wherein the step of confirming the response signal as one of a first address and a second address when the response signal is received comprises comparing the response signal with an address information to confirm the response signal as the first address when the response signal conforms with the address information and confirm the response signal as the second address when the response signal does not conform with the address information.

21. The method of claim 17, wherein the step of determining that the first connector is forward-connected to a second connector upon confirmation that the response signal is the first address is followed by the step of using two first input/output pins as receiving pins and two second input/output pins as transmitting pins, and the step of determining that the first connector is reverse-connected to the second connector upon confirmation that the response signal is the second address is followed by the step of using the two first input/output pins as transmitting pins and the two second input/output pins as receiving pins.

22. The method of claim 17, wherein the step of determining that the first connector is forward-connected to a second connector upon confirmation that the response signal is the first address is followed by the step of using two first input/output pins to support first signal format and the two second input/output pins to support second signal format, and the step of determining that the first connector is reverse-connected to the second connector upon confirmation that the response signal is the second address is followed by the step of using the two first input/output pins to support second signal format and the two second input/output pins to support first signal format.

* * * * *